US006744187B1

(12) United States Patent
Wimberly

(10) Patent No.: US 6,744,187 B1
(45) Date of Patent: Jun. 1, 2004

(54) LAMP ASSEMBLY WITH INTERNAL REFLECTOR

(75) Inventor: Randal L. Wimberly, 905 Tyree Rd., Paducah, KY (US) 42003

(73) Assignee: Randal L. Wimberly, Paducah, KY (US)

( * ) Notice: Subject to any disclaimer, the term of this patent is extended or adjusted under 35 U.S.C. 154(b) by 78 days.

(21) Appl. No.: 10/106,922

(22) Filed: Mar. 25, 2002

Related U.S. Application Data

(60) Provisional application No. 60/335,754, filed on Dec. 5, 2001.

(51) Int. Cl.[7] ..... H01J 5/16

(52) U.S. Cl. ..... 313/110; 313/111; 313/112; 313/113; 313/114

(58) Field of Search ..... 313/110, 111, 313/112, 113, 114

(56) References Cited

U.S. PATENT DOCUMENTS 654,208 A 7/1900 Washburn et al.
4,275,327 A * 6/1981 Walsh ..... 313/111
4,480,212 A 10/1984 Monahan et al.
4,703,220 A 10/1987 Walsh
5,057,735 A * 10/1991 Zalar et al. ..... 313/318.11
5,268,613 A 12/1993 Cunningham
5,438,233 A * 8/1995 Boland et al. ..... 313/110
5,466,981 A 11/1995 Fields et al.
5,535,111 A 7/1996 Wedell
5,610,469 A * 3/1997 Bergman et al. ..... 313/25

* cited by examiner

*Primary Examiner*—Ashok Patel
*Assistant Examiner*—Holly Harper
(74) *Attorney, Agent, or Firm*—King & Schickli, PLLC

(57) ABSTRACT

A lamp system includes an electric lamp having an internal reflector disposed within an envelope for redirecting light emitted from a filament away from a base of the lamp and onto the filament. Utilizing the internal reflector in this manner improves the efficiency and increases the life expectancy of the lamp by reducing the electrical current required to maintain an optimum temperature of the filament for producing light. Additionally, the ability to place the lamp filament in close proximity to the base of an external reflector alters the focal point of a lamp system incorporating the lamp, thereby allowing use of external reflectors of lesser bulk and diameter without sacrificing efficiency and intensity of the light beam emitted therefrom.

16 Claims, 2 Drawing Sheets

LAMP ASSEMBLY WITH INTERNAL REFLECTOR

This application claims the benefit of U.S. Provisional Application No. 60/335,754, filed Dec. 5, 2001.

TECHNICAL FIELD

The present invention relates to lamps and assemblies incorporating the lamps, and more specifically, to an assembly comprising an external reflector and an electric lamp having an internal reflector for redirecting light to provide more efficient operation.

BACKGROUND OF THE INVENTION

Ordinary lamp assemblies comprise a lamp, an external reflector for redirecting light emitted from the lamp in a desirable manner, and a housing surrounding the lamp and external reflector. Conventional single-ended electric lamps are inefficient in that significant portions of radiated light energy are lost. In a conventional incandescent lamp, for example, light energy radiating in the direction of the base of the lamp may be misdirected by the filament bridge and lost, or absorbed at the base of the lamp and converted into heat energy. Damage to the base of the lamp by such heat absorption is a significant cause of failure of conventional lamps.

Particularly in the case of use in theater, television, and architectural lighting, a high intensity, controlled beam of light is required. Concave external reflectors are ordinarily used in conjunction with conventional lamps to capture and redirect emitted light into a usable, controlled beam. Currently available external reflectors are typically shallow and of wide diameter relative to their depth. This is because the most efficient conventional external reflector design requires placement of the lamp filament as far as possible from the base of the reflector. This point is calculated to be the focal point of the lighting fixture. Conventional lamps must be placed with the filament near this focal point for the reflector to capture and redirect as much of the light emitted from the back of the filament and towards the base of the reflector as possible.

A significant disadvantage of this type of lamp assembly wherein the lamp filament is placed close to the mouth of an external reflector is that a portion of the light emitted from the filament is not captured and redirected by the external reflector, but rather is emitted forward of the reflector in an uncontrolled manner, failing to contact the external reflector at all. This uncontrolled light may also contact the interior of the lamp assembly housing and be absorbed as heat.

To overcome these deficiencies, secondary devices such as alternative filament designs or specialized external reflectors are often used to redirect the light path into the desired configuration. Such devices are disclosed, for example, in U.S. Pat. No. 5,268,613 to Cunningham and 5,466,981 to Fields et al., and are generally believed to be effective for their intended purpose. However, specialized filaments such as are disclosed by Cunningham, or integrated external reflectors such as are disclosed by Fields et al. do not wholly solve these problems and are complex and expensive to manufacture, thereby increasing the overall capital cost of the lighting fixtures incorporating them.

One solution for solving certain of the above problems relating to loss of light directed at the base of a lamp has been to include an internal reflector within the envelope of the lamp. For example, U.S. Pat. No. 5,535,111 to Wedell claims a lamp assembly comprising the combination of a housing, a lens affixed to the housing, a first (external) reflector supported by the housing, and a lamp located conventionally within the first reflector and housing. The lamp of U.S. Pat. No. 5,535,111 includes a second (internal) reflector having an outer edge adjacent the lamp envelope. Disadvantageously, this lamp design specifically requires placement of the second reflector in the lamp envelope in substantial alignment with the base of the first reflector to minimize passage of light into the base of the housing, essentially serving as a plug for the aperture in the base of the housing through which the lamp extends. Additionally, the base of the first reflector requires a downwardly protruding lip which surrounds the lower portion of the lamp, further reducing transmission of light into the base of the housing. Accordingly, the lamp of U.S. Pat. No. 5,535,111 must be placed in a specific orientation relative to the external reflector used, and further requires a specialized external reflector to maximize the amount of light recovered and emitted.

Therefore, there remains a need in the art for a lamp for use in situations requiring high intensity, controlled light beams which recovers and redirects substantially the entirety of the light energy emitted from the filament towards the base of the lamp and external reflector. There is also a need for a lamp which minimizes the amount of light lost at the mouth of the external reflector. Advantageously, the novel lamp described herein utilizes an internal reflector placed adjacent the filament, typically less than about an inch and more typically between about an inch and one-half inch from the filament, to redirect at least a portion of the light emitted from the filament back through the filament where a portion thereof is absorbed as heat energy, reducing the amount of electric current required to heat the filament to a desired operating temperature, and a portion thereof is emitted as useful visible light energy, thereby improving the efficiency of the novel lamp.

It will be appreciated by those of skill in the art that this novel lamp design eliminates the need to place the internal reflector in substantial alignment with the base of a specially designed external reflector while still allowing recapture and redirection of substantially the entirety of the light emitted from the filament towards the base of the lamp. Placement of the internal reflector adjacent to the lamp filament also allows orientation of the lamp relative to an external reflector such that the lamp filament, and therefore the focal point of the lamp assembly, is placed in closer proximity to the base of the external reflector than is possible with conventional lamp designs. This allows recapture and redirection of significantly more light than with conventional lamp designs regardless of the external reflector used.

The lamp of the present invention may therefore be used with any conventional external reflector, rather than requiring a specialized external reflector as is described in U.S. Pat. No. 5,535,111 to Wedell. However, the ability to place the lamp filament and therefore the focal point of a lamp assembly in close proximity to the base of an external reflector, rather than near the mouth of the external reflector as in conventional designs, also allows greater flexibility in the types of external reflector designs possible. The lamp of the present invention use of external reflectors which are of significantly narrower diameter than conventional reflectors. Smaller, less bulky lamp assemblies are therefore possible, without sacrificing efficiency of the lamp and intensity of the light beam emitted.

SUMMARY OF THE INVENTION

In accordance with the present invention, a lamp for producing light from an electric current supplied from an external source is provided. The lamp includes an envelope, a filament disposed within the envelope for producing the light, at least two filament supports, a base supporting the envelope and the filament supports having at least two contacts for supplying the electrical current from the external source to the filament, and a reflector disposed within the envelope for redirecting a portion of the light through the filament. Advantageously, the internal reflector reduces the electric current required to heat the filament to an optimum temperature for producing the light and maintain that temperature.

The internal reflector may be constructed of glass, ceramics, metal or any suitable material capable of efficiently reflecting heat and light energy, and capable of withstanding the internal operating temperatures of, for example, an incandescent or halogen cycle lamp. The internal reflector may be generally convex, concave, or planar in shape or a combination thereof so long as a sufficient amount of light required to heat the filament to an optimum temperature is redirected onto the filament. In one embodiment of the present invention, the internal reflector may be substantially concave for redirecting a significant portion of the light directly onto the filament. In another embodiment, the internal reflector may be further shaped such that a redirected portion of light not impinging on the filament combines with and emanates from the envelope in substantially the same direction as a remaining portion of light produced by the filament.

The internal reflector may be supported by a bridge attached to the filament supports between the base and the filament. In another embodiment, support for the internal reflector may be achieved using the filament supports or even separate support wires. The internal reflector may be positioned less than one inch from the filament, and preferably between about one inch and one-half inch from the filament. Positioning the internal reflector in this manner redirects light and heat energy away from the base of the lamp, thus reducing the exposure of the base to heat and recapturing light energy which may have been lost as described above.

A lamp assembly in accordance with the present invention includes the lamp described above, an external reflector, and a housing. The external reflector has an aperture in a first end thereof through which the lamp extends and a second end through with the light produced by the lamp is directed. The external reflector may be configured to extend in a substantially symmetrical fashion about a central longitudinal axis, and form a conical shape flaring outwardly from the aperture in the first end to the second end. Preferably, the external reflector prevents light produced by the filament from contacting and heating the housing which supports the lamp and the external reflector. Advantageously, this prevents overheating allowing the lamp assembly to be handled, even during long periods of operation.

In accordance with the method of the present invention, an electric current may be provided to a filament positioned within an envelope of the lamp. The filament radiates light in all directions and the filament is heated by reflecting at least a portion of the radiated light onto the filament. In this manner, the efficiency of the lamp may be improved by reducing the amount of electric current required to heat a filament to an optimum temperature for producing the light.

The method of reducing the amount of electric current required to heat a filament to an optimum temperature for producing light may include the additional step of supporting a substantially concave reflector in an envelope of the lamp adjacent the filament for reflecting a significant portion of the radiated light on the filament whereby the focal point of the light is the filament. Preferably, the reflector utilized in the supporting step is shaped such that the redirected portion of the light combines with and emanates from the envelope in substantially the same direction as a remaining portion of the light radiating from the filament. The reflector will typically be positioned between about one inch and one-half inch from the filament.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention and, together with the description, serve to explain the principles of the invention. In the drawings.

DETAILED DESCRIPTION OF THE INVENTION

Figure 1:
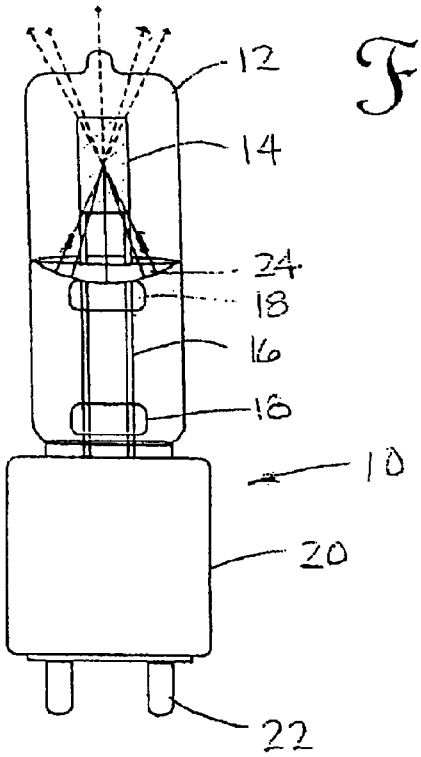
FIG. 1 is an elevational side view of a lamp having a substantially concave internal reflector disposed within an envelope for redirecting a portion of light initially generated by a filament back through the filament.

With reference to FIG. 1, there is shown a preferred embodiment of a lamp 10 including an envelope 12, a filament 14 for producing light, a plurality of filament support wires 16, a filament bridge 18, and a base 20 supporting the envelope and filament supports and having a plurality of electrical contacts 22 for supplying electric current to the filament. In accordance with an important aspect of the present invention, the lamp 10 further includes an internal reflector 24 disposed within the envelope 12 for redirecting a portion of the light away from the base 20 and through at least a portion of the filament 14. Redirecting the light in this manner advantageously heats the filament 14 thereby reducing the amount of electric current required to maintain an optimum filament temperature for producing light and recovering useful light that would normally be lost due to misdirection or absorption by the lamp base 20.

Figure 3:
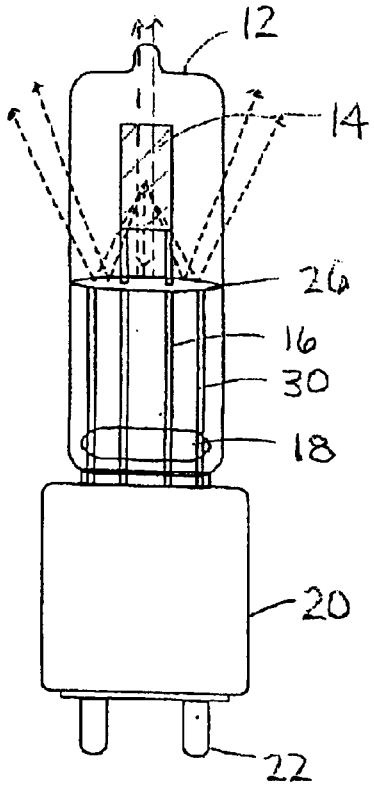
FIG. 3 is an elevational side view of a lamp having a substantially planar internal reflector disposed within an envelope for redirecting a portion of light initially generated by a filament back through the filament.

The internal reflector 24 is preferably shaped such that the redirected portion of the light combines with and emanates from the envelope 12 in substantially the same direction as a remaining portion of the light produced by the filament 14. More specifically, the internal reflector 24 may be any of several known shapes in accordance with the desired pattern of light scatter to be achieved. For example, the internal reflector 24 may be any shape of concave reflector known in the art, such as a spherical concave reflector, a parabolic concave reflector, or an ellipsoidal concave reflector. Alternate embodiments of the lamp 10 include a substantially planar internal reflector 26, shown in FIG. 3. In accordance with the broad teachings of the present invention, the internal reflector may be constructed of glass, ceramic, metal or any suitable material capable of efficiently reflecting heat and light energy, and capable of withstanding the internal operating temperatures of the lamp 12.

In the present preferred embodiment shown in FIG. 1, the internal reflector 24 is positioned less than an inch from and adjacent to the filament 14, and is supported by one of two filament bridges 18. Typically, the internal reflector 24 is supported between about one inch and one-half inch from the filament 14. It will be appreciated by those skilled in the art that the internal reflector 24 may also be supported by dedicated internal reflector support wires 30 shown in FIG. 3, or in other ways generally known in the art. As best shown in FIG. 1, the internal reflector 24 is shaped so as to capture and redirect light emitted from the filament 14 towards the base 20 of the lamp 10. In this manner, about 10 to about 14 percent of the light emitted from the filament 14 which is ordinarily lost through heat absorption in the base of prior art lamps is recovered. As described above, at least a portion of this light is redirected onto the filament 14 where its absorption is advantageous. The remaining portion is preferably redirected so as to combine with and emanate in the same direction as the light emitted from the filament 14.

As an example, it is known that the filament of a halogen cycle lamp operates most efficiently at a temperature between 2600 K and 3400 K dependant on the desired life of the lamp, the applied voltage and other nominal factors. By capturing and redirecting light, the back to the point of origin, i.e., the filament 14, the time and amount of electric current required to raise the temperature of its optimum operating temperature and to maintain the optimum temperature throughout operation is significantly reduced resulting in a more efficient and economical lamp.

In addition to the energy conservation advantages created by reflecting light and heat away from the base of the lamp 12, the internal reflector 24 of the present invention also protects the base 20 from heat damage thereby extending the life of the lamp 10.

Figure 2:
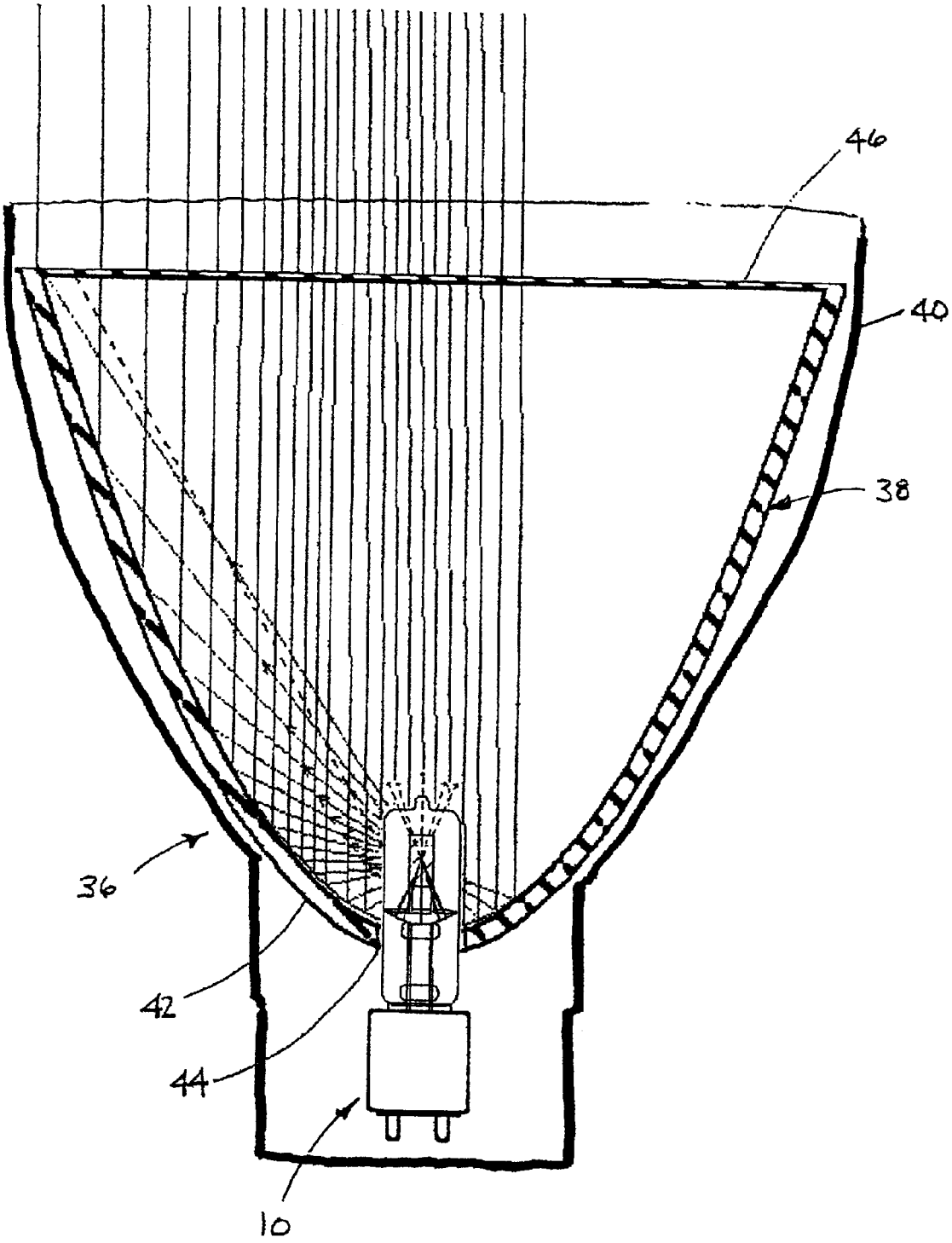
FIG. 2 is a cross-sectional view of a lamp assembly of the present invention including a lamp having an internal reflector, an external reflector, and a housing.

As shown in FIG. 2, a lamp system 36 incorporates the lamp 10 of the present invention. The lamp system 36 includes an external reflector 38, having a first end 42 which includes an aperture 44 through which the lamp envelope 12 extends. In the present embodiment, the external reflector 38 extends in a substantially symmetrical fashion about a central longitudinal axis forming a conical shape which flares outwardly from the first end 42 to a second end 46. In accordance with the broad teaching of the present invention, the external reflector 38 may be any shape, such as a parabolic, ellipsoidal, or other known reflector shapes, in accordance with the desired configuration of the light beam emitted therefrom.

In accordance with another aspect of the present invention, the lamp filament 14 is positioned in close proximity to the first end 42 of the external reflector 38. Such a close placement is possible due to the close proximity of the lamp internal reflector 24 to the filament 14. With conventional lamp/external reflector assemblies, a significant portion of the light directed towards the light-emitting end of the external reflector 38 does not contact the reflector 38 and is either absorbed by the housing or emits from the reflector 38 in an undesired and useless direction, and does not contribute to the desired tightly controlled beam of light. It has been surprisingly discovered that the placement of the lamp 10/filament 14 in such close proximity to the first end 42 of external reflector 38, allows the capture and redirection of an additional 19 to about 25 percent of the total light energy emitted by the filament, which does not contact conventional external reflectors. This is because, due to the placement of the internal reflector 24 between about one inch and one-half inch from the filament 14, substantially the entirety of both the light emitted towards the base 20 of the lamp 10 and the first end 42 of the external reflector 38 and the light emitted towards the second end 46 of the external reflector 38 are captured and redirected in a useful pattern, i.e. the tightly controlled, narrow beam depicted schematically in FIG. 2. This light energy would otherwise be lost or unusable as in many prior art lamp systems as briefly discussed above in the absence of specially designed external reflectors such as that in U.S. Pat. No. 5,535,111 to Wedell, or specialized focusing lenses placed at the light-emitting end of external reflectors as discussed above.

Further, as will be appreciated by those of skill in the art, placement of the filament 14 in close proximity to the external reflector 38 alters the focal point of the resulting lamp system 36. Accordingly, while the lamp 10 of the present invention functions to improve the light-emitting efficiency of any conventional external reflector 38, novel external reflectors 38 which are deeper than most prior art reflectors (resulting in a relatively small diameter of the second end 46 and in lamp systems 36 of significantly lesser size and bulk) are now also possible. Essentially, the lamp system 36 of the present invention allows the utilization of substantially all light emitted from the lamp filament 14 to heat the filament 14 thereby reducing the amount of electric current required to produce the light and to form a tightly controlled, narrow beam of light in a most efficient manner. One additional advantage of the present lamp 10 and lamp system 36 is its ability to form a tightly controlled and narrow beam of light without the need for secondary devices such as lenses, specialized external reflector designs, or the like.

In accordance with the method of the present invention, an amount of electric current required to heat a filament of a lamp to maintain an optimum temperature for producing light is significantly reduced by reflecting at least a portion of light radiated by the filament back onto the filament, thus heating the filament with light energy which would otherwise be lost through absorption. In this manner, the efficiency and useful life of the lamp are improved.

The method of improving the efficiency of a lamp may include the additional step of supporting a substantially concave reflector less than an inch, typically between about one inch and one-half inch from the filament for capturing and redirecting a significant portion of the radiated light onto the filament. In addition, the reflector may be shaped such that the redirected portion of the light combines with and emanates from the lamp in substantially the same direction as a remaining portion of the light radiating from the filament.

In summary, a lamp includes an internal reflector for redirecting a portion of the light emitted by a filament away from a base of the lamp through at least a portion of the filament. The internal reflector may be shaped such that the redirected portion of the light combines with and emanates from the lamp in substantially the same direction as a remaining portion of the light produced by the filament. The internal reflector must be positioned less than an inch from the filament. Advantageously, reflecting light in this manner reduces the amount of electric current required to maintain an optimum filament temperature for producing light thus improving the efficiency of the lamp and extending its useful life.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A lamp for producing light from an electric current supplied from an external source, comprising:

an envelope;

a filament disposed within said envelope for producing the light;

at least two filament supports;

a base supporting said envelope and said filament supports, said base having at least two contacts for supplying the electric current from the external source to said filament; and a reflector disposed within said envelope between said base and said filament, and positioned less than one inch from said filament for redirecting a portion of the light through said filament.

2. The lamp of claim 1, wherein said reflector is substantially concave and redirects a significant portion of the light directly onto said filament whereby a focal point of said redirected light is the filament, thereby heating the filament such that the electric current required to maintain an optimum filament temperature for producing light is reduced.

3. The lamp of claim 2, further comprising a bridge attached to said filament supports for supporting said reflector.

4. The lamp of claim 1, wherein said reflector is shaped such that the redirected portion of the light combines with and emanates from said envelope in substantially the same direction as a remaining portion of the light produced by said filament.

5. The lamp of claim 4, wherein said reflector is substantially concave and redirects a significant portion of the light directly onto said filament whereby a focal point of said redirected light is the filament.

6. The lamp of claim 1, wherein said reflector is positioned between about one inch and one-half inch from said filament.

7. A method of improving the efficiency and extending the useful life of a lamp by reducing an amount of electric current required to heat a filament to maintain an optimum temperature for producing light, comprising:

providing an electric current to a filament positioned within an envelope of the lamp;

radiating light from said filament in all directions; and heating said filament by reflecting at least a portion of the radiated light thereon whereby a focal point of said reflected light is the filament.

8. The method of improving the efficiency of a lamp of claim 7, further comprising supporting a substantially concave reflector less than one inch from said filament to reflect a significant portion of the radiated light on said filament, whereby a focal point of said reflected light is the filament.

9. The method of improving the efficiency of a lamp of claim 7, wherein said reflector is shaped such that the redirected portion of the light combines with and emanates from said envelope in substantially the same direction as a remaining portion of the light radiating from said filament.

10. The lamp of claim 8, wherein said reflector is positioned between about one inch and one-half inch from said filament.

11. A lamp assembly for producing light from an electric current supplied from an external source and directing the light, comprising:

a lamp having an envelope, a filament disposed within said envelope for producing the light, at least two filament supports, a base supporting said envelope and said filament supports, said base having at least two contacts for supplying the electric current from the external source to said filament, and an internal reflector for redirecting a portion of the light away from said base and through at least a portion of said filament, said internal reflector positioned between said base and said filament and less than an inch from the filament; and an external reflector supporting said lamp adjacent a first end and directing the light produced by said lamp through a second end.

12. The lamp assembly of claim 11, wherein said internal reflector is shaped to redirect a sufficient amount of the light onto said filament whereby a focal point of said redirected light is the filament, to create heat in said filament, whereby the electric current required to maintain an optimum filament temperature for producing light is reduced.

13. The lamp assembly of claim 12, wherein the shape of said internal reflector is selected from the group of concave or planar.

14. The lamp assembly of claim 11, wherein said internal reflector is shaped such that the redirected portion of the light combines with and emanates from said envelope in substantially the same direction as a remaining portion of the light produced by said filament.

15. The lamp of claim 11, wherein said reflector is positioned between about one inch and one-half inch from said filament.

16. The lamp of claim 12, wherein said reflector is positioned between about one inch and one-half inch from said filament.

* * * * *